US010038950B2

(12) United States Patent
Avliav et al.

(10) Patent No.: US 10,038,950 B2
(45) Date of Patent: Jul. 31, 2018

(54) MICROPHONE COVER/REFLECTOR

(71) Applicants: Avi Avliav, Woodland Hills, CA (US); Barak Mevorak, Woodland Hills, CA (US)

(72) Inventors: Avi Avliav, Woodland Hills, CA (US); Barak Mevorak, Woodland Hills, CA (US)

( * ) Notice: Subject to any disclaimer, the term of this patent is extended or adjusted under 35 U.S.C. 154(b) by 0 days.

(21) Appl. No.: 15/217,353

(22) Filed: Jul. 22, 2016

(65) Prior Publication Data

US 2018/0027316 A1 Jan. 25, 2018

(51) Int. Cl.

| | |
|---|---|
| ***H04R 1/08*** | (2006.01) |
| ***H04R 1/02*** | (2006.01) |
| ***H04R 1/34*** | (2006.01) |
| ***G10K 11/20*** | (2006.01) |
| *H04R 1/00* | (2006.01) |

(52) U.S. Cl.
CPC ..... *H04R 1/086* (2013.01); *G10K 11/20* (2013.01)

(58) Field of Classification Search
CPC ..... H04R 1/086; H04R 1/021; H04R 1/342; H04R 1/02; G10K 11/20
USPC ..... 181/155, 158; 381/355, 359, 122, 356
See application file for complete search history.

(56) References Cited

U.S. PATENT DOCUMENTS 3,244,816 A * 4/1966 Karns ..... G09B 5/04 181/198
3,443,661 A * 5/1969 Van Sciver ..... H04B 1/086 181/199
3,748,397 A * 7/1973 Jones ..... H04M 1/60 379/395
3,881,056 A * 4/1975 Gibson ..... H04R 1/342 381/160
3,895,188 A * 7/1975 Ingraham ..... G10K 11/08 367/104
D242,634 S * 12/1976 Timm ..... D14/227
4,037,052 A * 7/1977 Doi ..... H04R 1/34 381/160
5,923,002 A 7/1999 McGrath et al.
6,510,311 B1 * 1/2003 Stitt ..... H04M 1/0214 455/557

(Continued)

FOREIGN PATENT DOCUMENTS

CN 202026443 U 11/2011
JP 2000-013881 A 1/2000

OTHER PUBLICATIONS

Vb2go: "Carry-On Vocal Booth Instructions," Aug. 29, 2012, pp. 1-4, XP055413062, https://www.vocalboothtogo.com/carry-on-vocal-booth-instructions/, retrieved Oct. 5, 2017.

(Continued)

*Primary Examiner* — Edgardo San Martin
(74) *Attorney, Agent, or Firm* — Arent Fox LLP

(57) ABSTRACT

The present system provides a microphone cover assembly that is portable, lightweight, and can be used when the microphone is attached to a microphone stand or when it is unattached. The cover assembly provides environmental and physical protection for a microphone. In addition, the microphone cover can be used as a sound reflector when in an opened condition, eliminating the need for a separate microphone reflector when the microphone is in operation.

9 Claims, 8 Drawing Sheets

(56) References Cited

U.S. PATENT DOCUMENTS 6,520,282 B1 * 2/2003 Hadzic ..... H04R 5/00 181/155
7,197,140 B2 * 3/2007 Asaro ..... H04M 1/19 379/433.03
7,515,708 B1 * 4/2009 Doty, III ..... H04M 1/19 379/433.11
7,783,069 B1 * 8/2010 Miller ..... H04R 1/342 381/345
8,069,946 B1 * 12/2011 Cruise, III ..... H04R 1/28 181/198
8,086,285 B2 * 12/2011 McNamara ..... H04B 1/3888 379/426
8,191,678 B2 * 6/2012 Zou ..... G10K 11/168 181/284
8,433,377 B1 * 4/2013 Oh ..... F16M 11/10 345/158
8,646,571 B2 * 2/2014 Aliev ..... G10K 11/16 181/198
8,737,662 B2 * 5/2014 Zukowski ..... H04R 1/342 381/354
9,118,989 B2 * 8/2015 Zukowski ..... H04R 1/086
9,198,305 B2 * 11/2015 Smith ..... G10K 11/28
2002/0040861 A1 4/2002 Terzian
2005/0281426 A1 * 12/2005 Peavey ..... H04R 1/02 381/334
2013/0048413 A1 * 2/2013 Patzer ..... H04M 1/04 181/199
2013/0322673 A1 * 12/2013 Yuhara ..... G10G 7/005 381/334
2014/0064543 A1 * 3/2014 Zukowski ..... H04R 1/342 381/360
2016/0360303 A1 * 12/2016 Armstrong ..... H04R 1/021

OTHER PUBLICATIONS

Extended European Search Report issued in EP Patent Application No. 17182819.7 dated Oct. 18, 2017.

* cited by examiner

700

| |
|---|
| 703 |
| 702 |
| 701 |

FIGURE 7

MICROPHONE COVER/REFLECTOR

BACKGROUND OF THE SYSTEM

Microphones are expensive pieces of audio equipment that require protection from dust, temperature, moisture, shock, drops, and other environmental hazards, In addition, when a microphone is to be transported, it requires a carrying case to provide protection from the environment. In the prior art, many microphones are sold with a carrying case that includes a foam packed interior with a cutout in the shape of the microphone, along with a foam cover separate from, or integral with a lid on the carrying case. In other instances, third party carrying cases and protective covers are used for microphone protection and/or transportation. The prior art solutions have a number of disadvantages, including large size, expense, difficulty in carrying multiple microphones at once, cost of shipping large cases, and inability to use with a microphone when the microphone is attached to its stand. In addition, the prior art covers and cases do not perform any other function associated with microphone use.

SUMMARY

The present system provides a microphone cover assembly that is portable, lightweight, and can be used when the microphone is attached to a microphone stand or when it is unattached. The cover assembly provides environmental and physical protection for a microphone, including protection from humidity, dust, and blunt trauma. In addition, the microphone cover can be used as a sound reflector when in an opened condition, eliminating the need for a separate microphone reflector when the microphone is in operation.

BRIEF DESCRIPTION OF THE DRAWINGS

FIG. 7 illustrates the construction of the cover assembly in one embodiment.

DETAILED DESCRIPTION OF THE SYSTEM

During audio recording it is desired to neutralize the acoustic effects of the recording environment. The goal is to maximize the pickup of direct sound, that is the sound made directly into a microphone by the recording artist or musician, and minimize the indirect sounds caused by echoes and reflections of the direct sound due to the recording environment. In a professional recording studio, this can be accomplished by using a so called recording booth, vocal booth, or isolation booth, which are acoustically designed to remove echoes, reflections, dead zones, and other ambient noise. In other environments, acoustic panels have been developed to reduce or eliminate indirect sounds. These solutions suffer from a number of disadvantages, including expense, complexity, and lack of portability.

In addition, there is a need to provide a way to protect and/or transport a microphone when it is not in use, to ensure maximum performance when in operation. This includes the need to protect the microphone from environmental problems such as dust, temperature swings, humidity, and the like, as well as from physical problems such as physical movement, contact with surfaces, bumping, dropping, and the like.

Figure 1A:
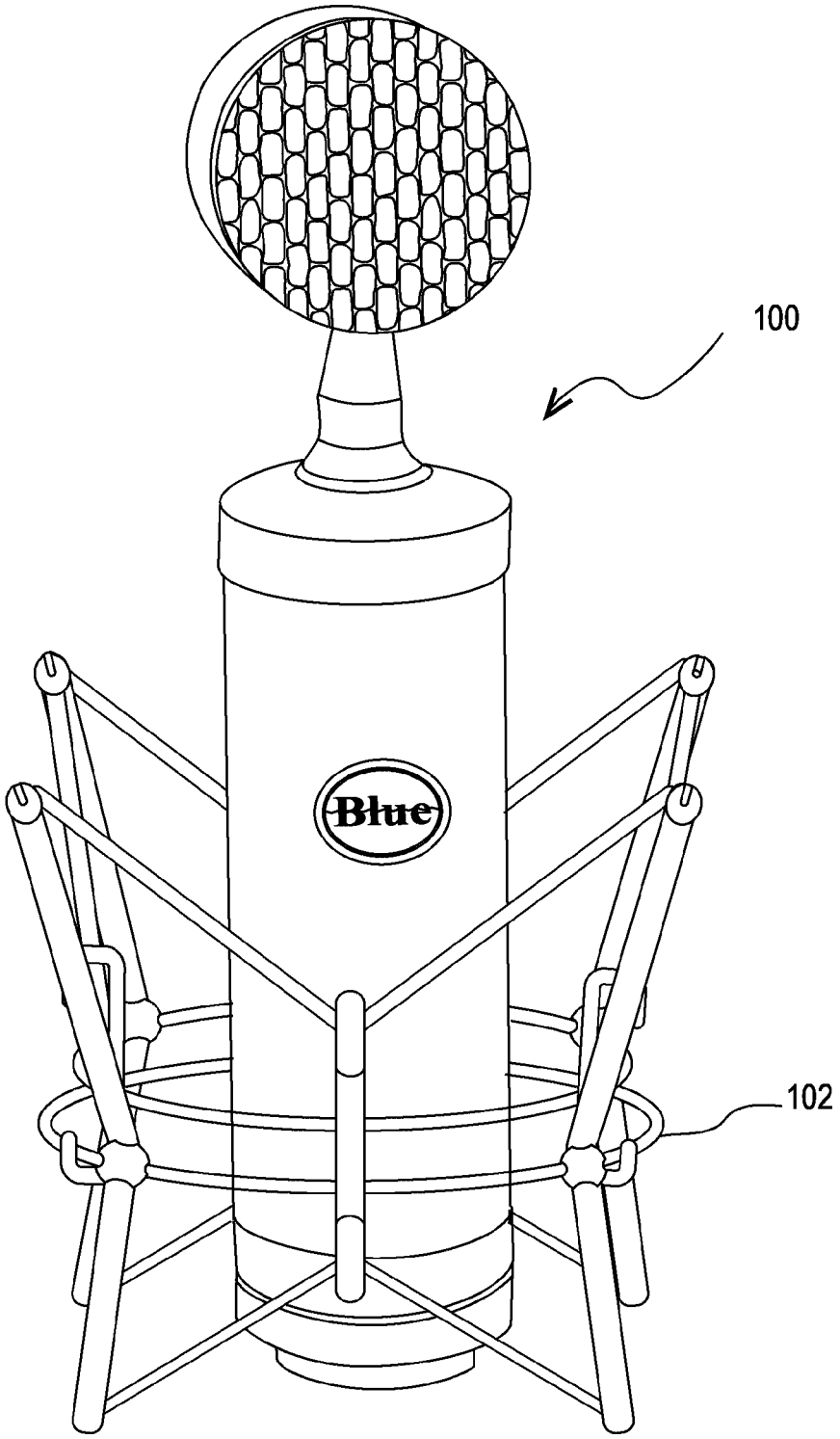
FIGS. 1A and 1B are examples of microphones that can be used with the cover assembly.
Figure 1B:
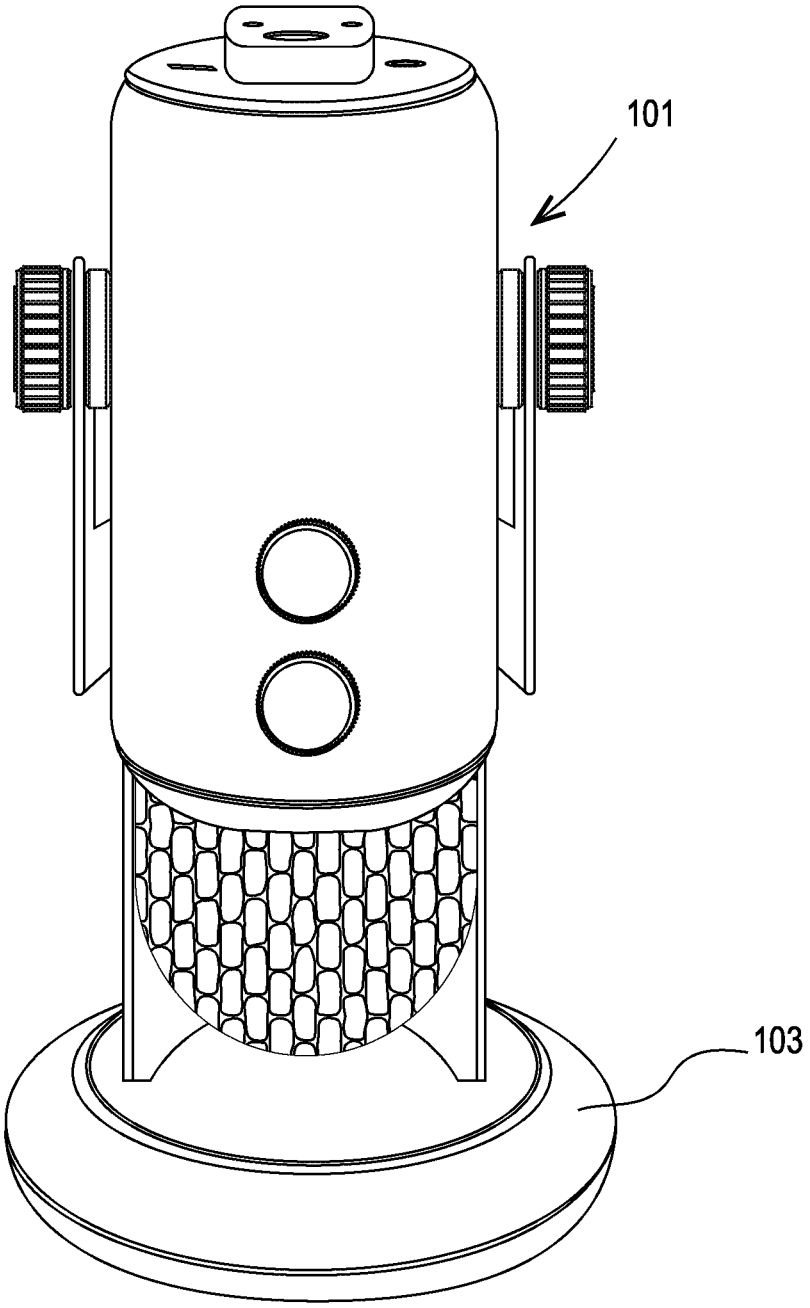

The system provides a microphone cover assembly that functions both as a cover and as an operational reflector for use with a microphone. FIGS. 1A and 1B illustrate example microphones that can be used with the system. The microphones 100, 101 can be used with an integrated stand 102, 103 or can be attached to a microphone stand (not shown). Often, when attached to a microphone stand, it is still desirable to cover the microphone when not in use to provide environmental and physical protection for the microphone. The present system is not limited to the example microphones of FIGS. 1A and 1B but may be implemented with any microphones without departing from the spirit and scope of the system.

Figure 2:
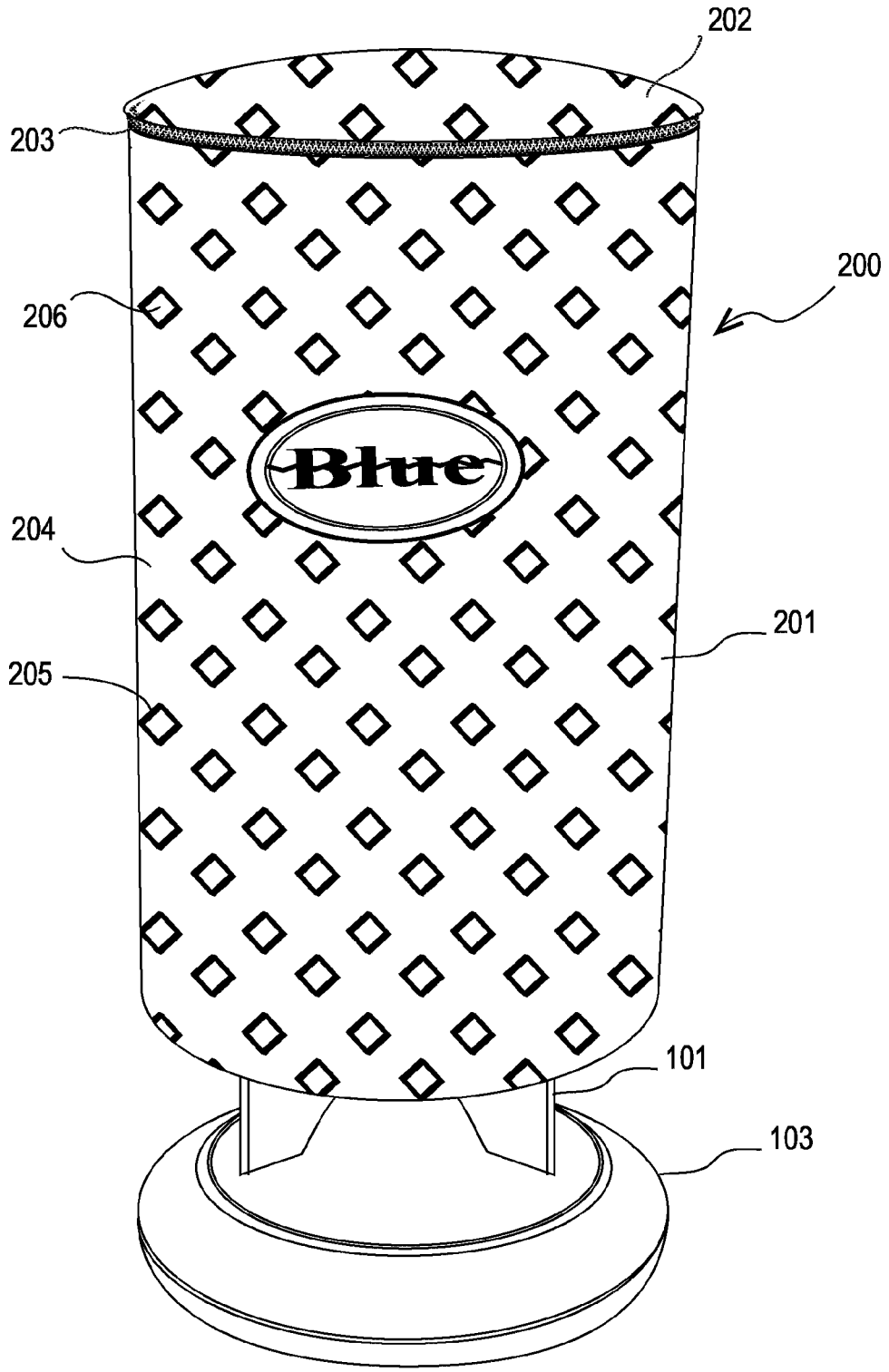
FIG. 2 illustrates the cover assembly in use over a microphone.

FIG. 2 illustrates the microphone cover assembly 200 in operation in covering a microphone 101. The microphone 101 is disposed on its integrated stand 103 but the microphone cover assembly 200 could be used when the microphone 101 is mounted on a microphone stand as well. The microphone cover assembly 200 is comprised of a main body 201 with lid 202. The lid 202 is attached to the main body 201 via a fastening means 203. In one embodiment the fastening means 203 comprises a zipper. However, the fastening means 203 could be any suitable means of coupling the lid 202 to the main body 201, including, but not limited to, Velcro, sliding fastener, snaps, clips, magnets, and the like.

The main body 201 is comprised, in one embodiment, of a mesh 204 over a solid layer 206, with the mesh including a plurality of openings 205. The mesh 204 may be somewhat elastic in nature to help maintain the shape of the assembly. The mesh may be comprised of fabric, elastomeric material, plastic, vinyl, and the like. In one embodiment, the mesh is included on the lid 202. In one embodiment, the mesh may be disposed such that it extends over the fastening means when in use. The surface of the main body 201 may be any neoprene in one embodiment of the system.

Figure 3:
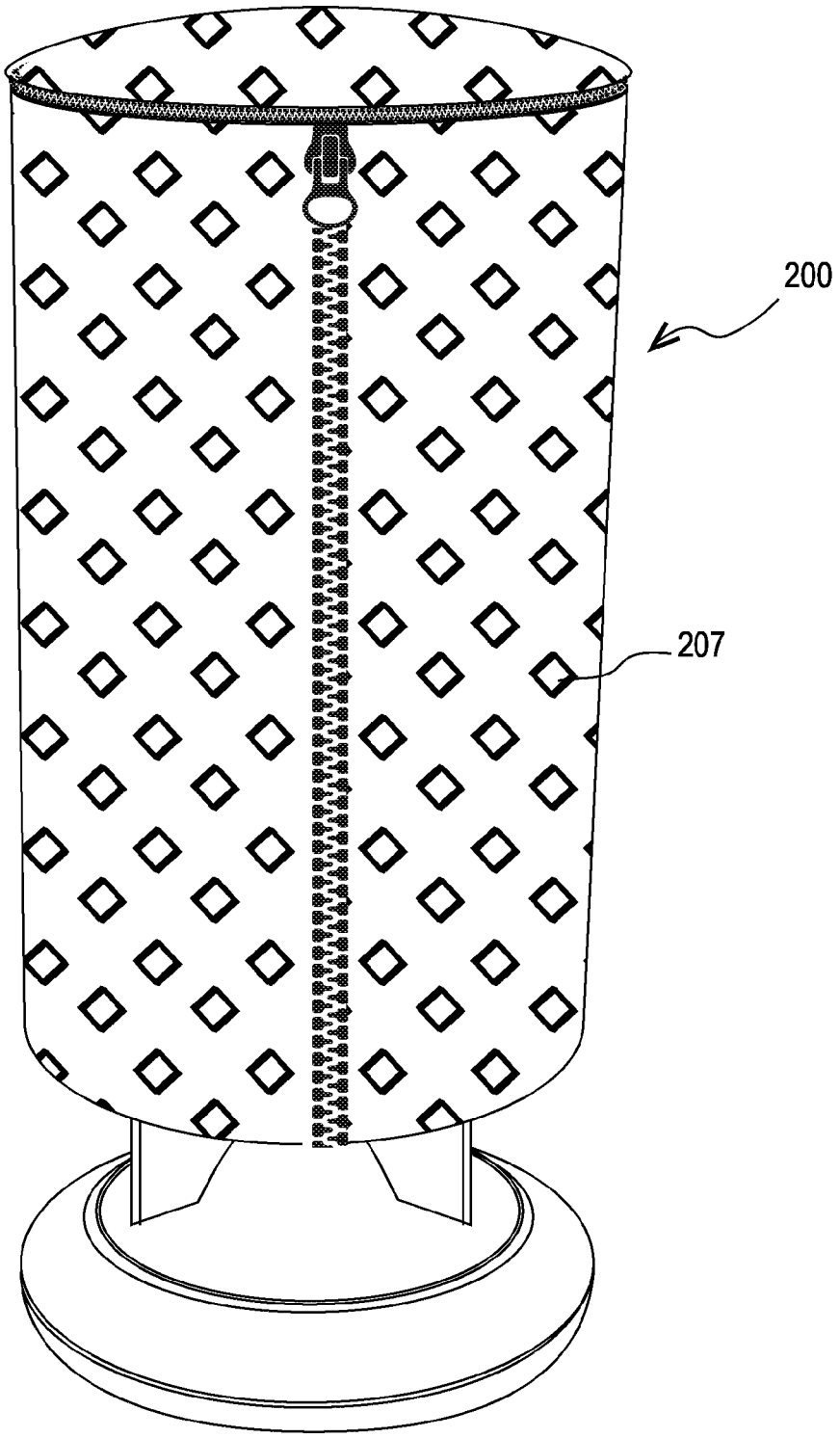
FIG. 3 is a rear view of the microphone cover assembly of FIG. 2.

The general shape of the microphone cover assembly may be essentially cylindrical with one open end that allows the assemble to be placed over a microphone 101. As shown in FIG. 3, the microphone cover assembly 200 may include a fastener 207 that allows the main body 201 to be closed and opened as desired. The fastener 207 is illustrated as a zipper by way of example, but could be implemented by Velcro, snaps, clips, sliding fasteners, magnets, and the like.

Figure 4:
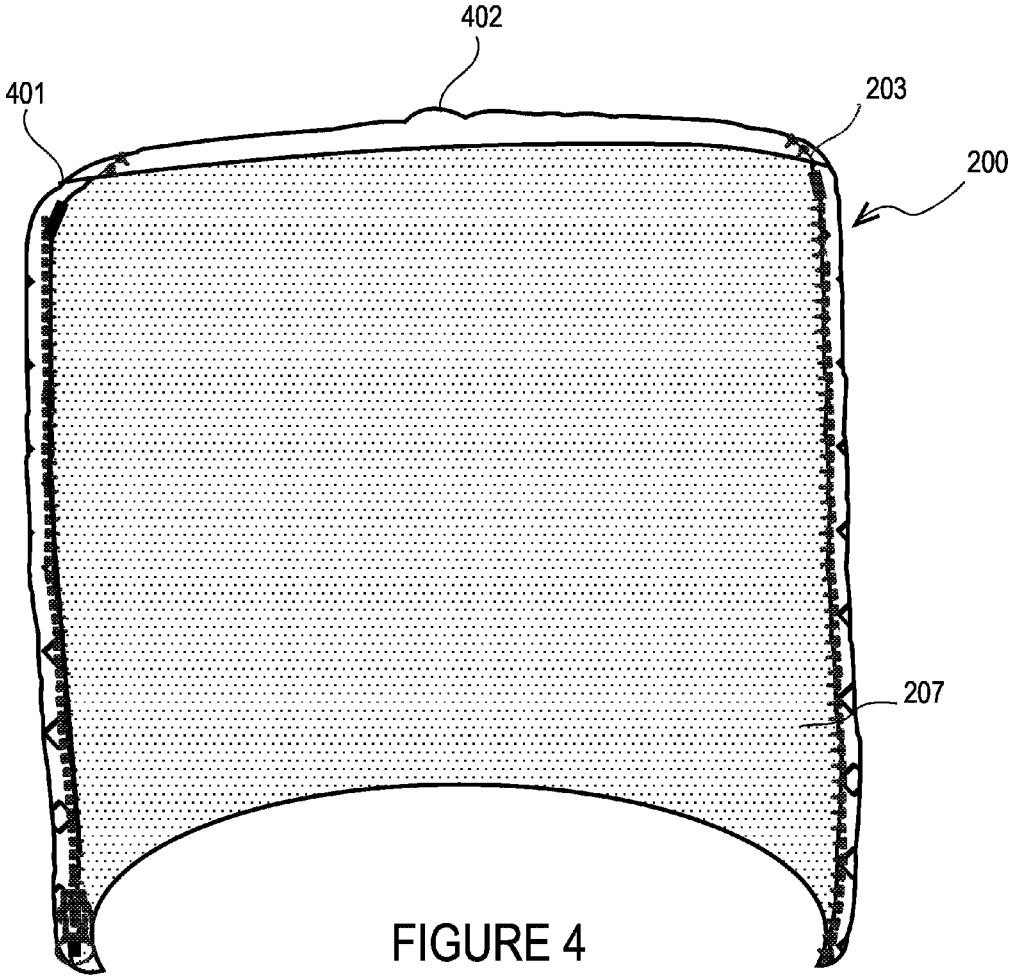
FIG. 4 illustrates the cover assembly in an open position.

The microphone cover assembly may be used as an audio shield/reflector in addition to being used as a cover. FIG. 4 illustrates the microphone cover assembly 200 in an open position 401 with fasteners 203 and 207 opened. The lid 202 (not shown in FIG. 4) is held to the main body 201 via a hinge 404 in the embodiment shown. In another embodiment, the fastener 203 is such that the lid 202 can be completely removed from the main body 201 when the microphone cover assembly 200 is to be used as a shield/reflector.

Figure 5:
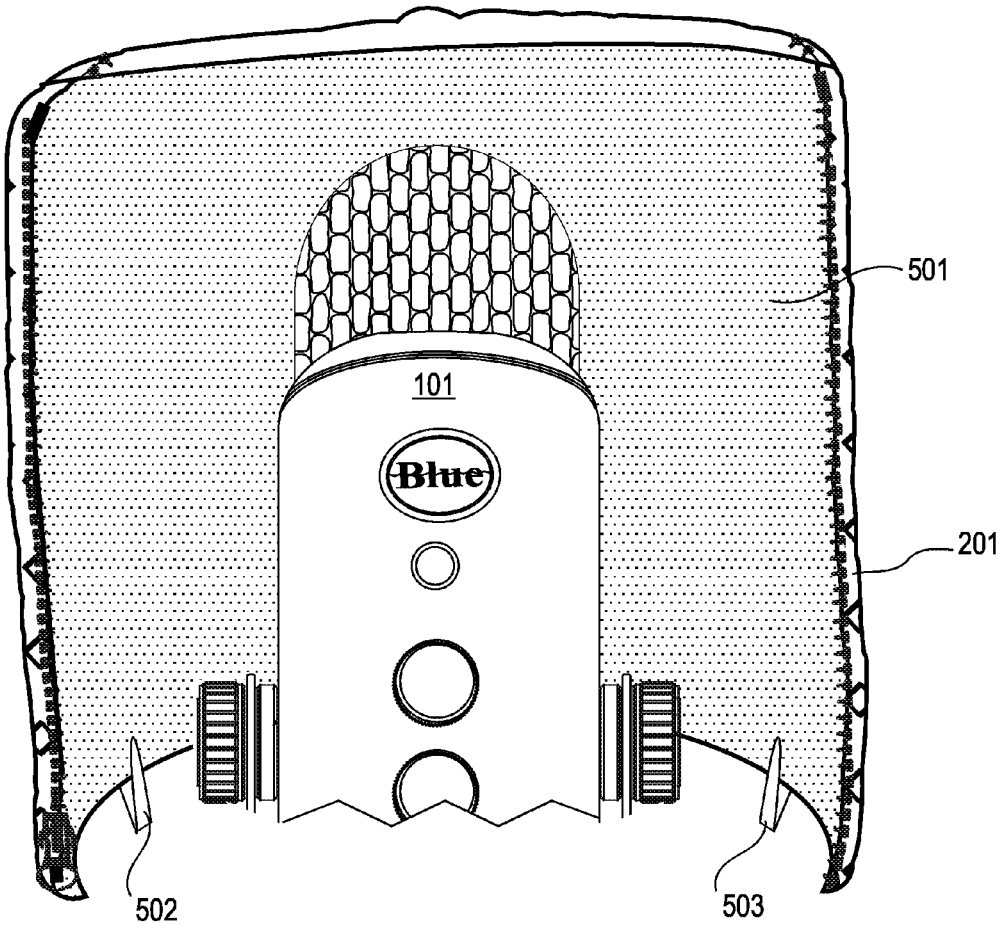
FIG. 5 illustrates the cover assembly attached to a microphone
Figure 6:
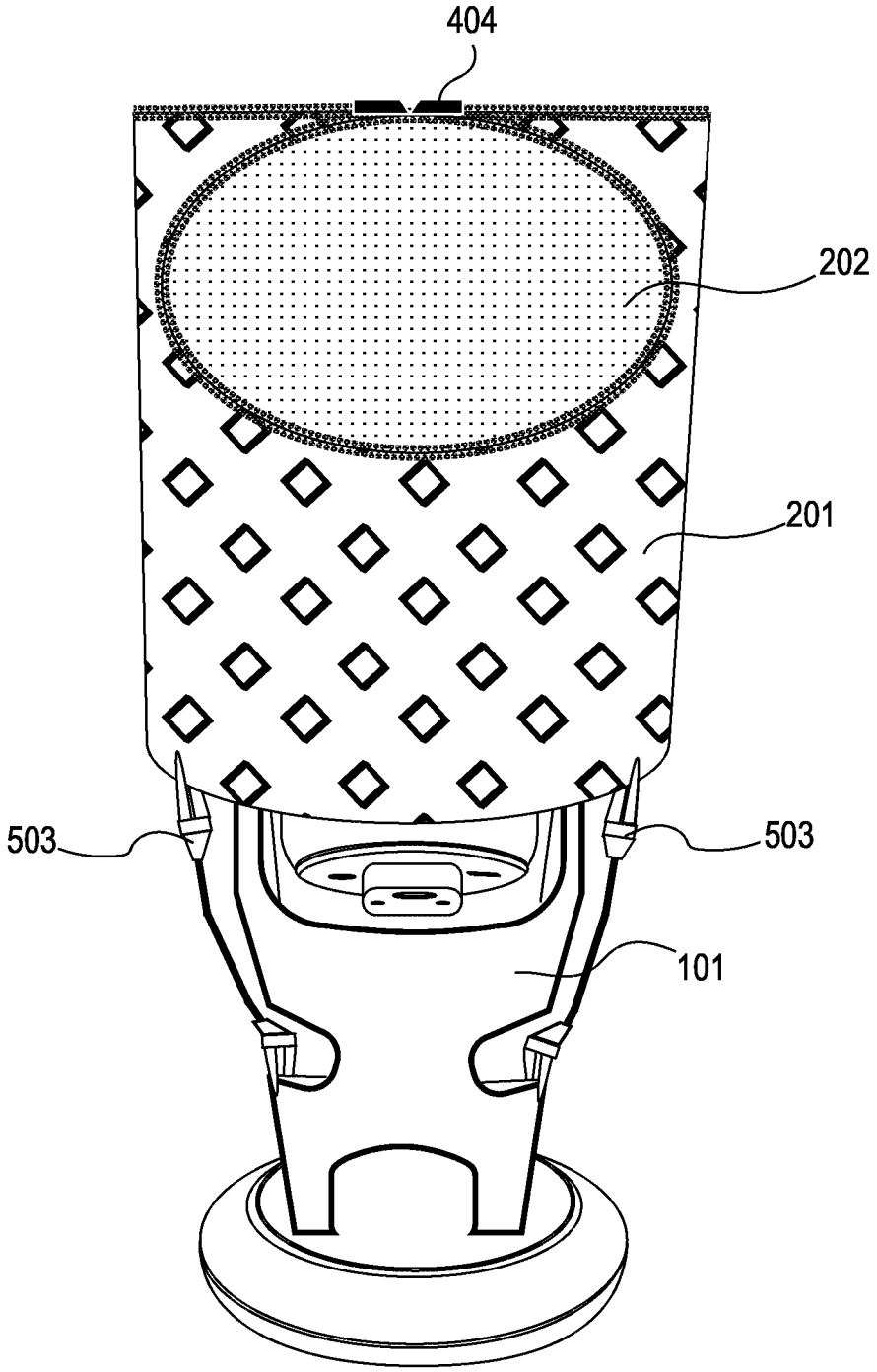
FIG. 6 illustrates a rear view of the cover assembly of FIG. 5.

The microphone cover assembly 200 is constructed to have a bias to be in a somewhat curved orientation when open, providing a suitable audio reflecting environment when in use. FIG. 5 illustrates the microphone cover assembly 200 when in use as an audio shield/reflector. The inner surface 501 of the assembly is comprised of a foam material that, in conjunction with other layers in the construction of the assembly (described below), provides suitable sound reflection. In one embodiment, the assembly surface on the side near the microphone should absorb in the range of 10% to 50% of incident sound on the assembly surface over a frequency range of between 8 kHz to 100 Hz. On the surface of the assembly opposite the microphone, the mesh provides additional acoustic shaping qualities. First, the mesh serves to diffuse and disperse sound that is transmitted through the assembly, reducing the acoustic magnitude so that echoes and reflections will be diminished. Secondly, any sound that is reflected back towards the back surface of the assembly will again be diffused by the mesh layer, diminishing its impact on the microphone.

In one embodiment, the mesh openings are diamond shaped, but other shapes may be used without departing from the scope and spirit of the system. The dimensions of the mesh openings are approximately in the range of 1/16 inch to ½ inch and the dimensions of the mesh material between the openings are approximately In the same range.

FIG. 7 illustrates the composition of the assembly in one embodiment of the system. The assembly composition 700 comprises a mesh layer 701 which may be in the range of 0.5 mm to 5 mm in thickness and is comprised of, stretch vinyl, cloth, elastic, neoprene and the like. The inner layer 702 is a semi-rigid layer in the range of 3 mm to 5 mm in thickness. The inner 702 may be comprised of cardboard and is used to provide shape to the main body 201 and to urge it into an open position when the fasteners 203 and 207 are opened. The semi-rigid layer 702 may be comprised of any suitable material that provides an urging of the main body to an opened position, such as plastic, rubber, and the like.

In one embodiment, the assembly can be used without fasteners. The assembly can be placed on a surface, such as for example, with the top cover serving as a base for the microphone, providing additional sound isolation.

In one embodiment, the inner layer may have one or more hinges that define relatively flat sections of the assembly when opened, in that case, the user can determine the orientation of the assembly by positioning the clips 502, 503 as desired. More clips may be used as necessary to retain and place the assembly in the shield/reflecting position. In one embodiment, no clips are required and the assembly can simply stand behind a microphone.

The top layer 703 is comprised of neoprene in one embodiment and is in the range of 3 mm to 5 mm in thickness. Top layer 703 may also be comprised of some other suitable material. The thicknesses are given by way of example only and the system may be implemented with layers of varying thicknesses as desired. Regardless of the thicknesses of the layers, the assembly should be able to be moved from a closed position to an open position that provides a partial surrounding of the microphone when in use as a shield/reflector. In one embodiment, the top layer 73 is comprised of fabric with foam spacer. In other embodiments, additional layers may be used.

In one embodiment, the lower, open portion of the assembly may include a separate fastener and cover for completely sealing a microphone for portability or storage when not in use. Alternatively the bottom portion may have an integral drawstring that can be used to close up the bottom opening for transportation or storage.

Thus, a combined microphone cover/reflector has been described.

What is claimed is:

1. A microphone cover comprising:

a main body having a first fastener thereon, wherein the main body is configured to removably surround an exterior of a microphone;

wherein the main body is configured to act as a free standing sound reflector when the first fastener is released, wherein the main body is disposed separately from a microphone; and wherein the microphone cover surrounds and conforms to the exterior of the microphone when the first fastener closes the main body.

2. The microphone cover of claim 1 wherein the main body is comprised of a first sound reflecting layer, a second form shaping layer, and a third mesh layer.

3. The microphone cover of claim 2 wherein the third mesh layer diffuses sound waves.

4. The microphone cover of claim 2 wherein the first sound reflecting layer provides 10% to 50% reflection of direct sounds.

5. The microphone cover of claim 1 wherein the first fastener comprises a zipper.

6. The microphone cover of claim 1 wherein the first fastener comprises Velcro.

7. The microphone cover of claim 2 wherein the first sound reflecting layer is between 2 and 5 mm in thickness.

8. The microphone cover of claim 2 wherein the first sound reflecting layer is comprised of neoprene.

9. The microphone cover of claim 1 wherein the microphone cover is essentially cylindrical.

* * * * *